United States Patent [19]

Eichinger et al.

[11] Patent Number: 5,026,457

[45] Date of Patent: Jun. 25, 1991

[54] PROCESS FOR SIZING IN THE PRODUCTION OF PAPER, CARDBOARD, PAPERBOARD AND OTHER CELLULOSE CONTAINING MATERIALS

[75] Inventors: Rudolf Eichinger, Graz; Horst Michaud; Josef Seeholzer, both of Trostberg, all of Fed. Rep. of Germany

[73] Assignee: SKW Trostberg Aktiengesellschaft, Trostberg, Fed. Rep. of Germany

[21] Appl. No.: 317,113

[22] Filed: Feb. 28, 1989

Related U.S. Application Data

[63] Continuation of Ser. No. 91,317, Aug. 28, 1987, abandoned, which is a continuation of Ser. No. 815,409, Dec. 31, 1985, abandoned.

[30] Foreign Application Priority Data

Jan. 8, 1985 [DE] Fed. Rep. of Germany ..... 3500408

[51] Int. Cl.[5] ..... D21H 17/49

[52] U.S. Cl. ..... 162/158; 162/166; 162/167; 162/172; 162/174; 162/175; 162/179; 162/180

[58] Field of Search ..... 162/166, 167, 158, 172, 162/174, 175, 180, 179

[56] References Cited

U.S. PATENT DOCUMENTS

| | | | |
|---|---|---|---|
| 3,016,325 | 1/1962 | Pattilloch | 162/180 |
| 3,957,574 | 5/1976 | Anderson | 162/166 |
| 4,240,935 | 12/1980 | Dumas | 162/158 |
| 4,299,654 | 11/1981 | Tlach et al. | 162/167 |

FOREIGN PATENT DOCUMENTS

| | | | |
|---|---|---|---|
| 618976 | 4/1961 | Canada | 162/167 |
| 1070916 | 12/1959 | Fed. Rep. of Germany . | |
| 2250995 | 5/1973 | Fed. Rep. of Germany . | |
| 1218904 | 3/1960 | France . | |
| 73909 | 6/1979 | Japan | 162/167 |
| 174696 | 10/1983 | Japan | 162/167 |
| 1373788 | 11/1974 | United Kingdom | 162/158 |

OTHER PUBLICATIONS

Casey, *Pulp and Paper*, 3rd ed., vol. III (1981), pp. 1594–1599.

*Primary Examiner*—Peter Chin
*Attorney, Agent, or Firm*—Felfe & Lynch

[57] ABSTRACT

The present invention provides a process for sizing in the production of paper, cardboard, paperboard and other cellulose-containing materials with and without filling materials and/or pigments by natural or synthetic sizing agents under neutral to weakly basic pH conditions without the use of aluminum salts, wherein sizing is carried out with a combination of natural or synthetic sizing agents with a cationic dicyandiamide resin.

10 Claims, No Drawings

PROCESS FOR SIZING IN THE PRODUCTION OF PAPER, CARDBOARD, PAPERBOARD AND OTHER CELLULOSE CONTAINING MATERIALS

This is a continuation of application Ser. No. 091,317 filed on Aug. 28, 1987, which is a continuation of application Ser. No. 815,409, filed on Dec. 31, 1985, now abandoned.

The present invention is concerned with a process for sizing in the production of paper, cardboard, paperboard and other cellulose-containing materials with and without filling materials and/or coating pigments, under neutral to weakly basic pH conditions.

The production of paper requires, for the binding of the resin size on the fibre surface, a mediator or a fixing agent since not only the resin size but also the cellulose fibres are electronegatively charged and are mutually repellent. In the case of the production of paper in an acidic medium, alum (aluminium sulphate hydrate) is used almost exclusively for this purpose, the best sizing being achieved in the case of a pH value of the material of from 4.5 to 5.5. However, papers so produced are not stable against ageing as a result of progressive hydrolysis.

Therefore, attempts have been made to size paper under neutral conditions. The use of alum is, however, hereby not possible since the aluminium ion rapidly loses its positive charge in this pH range and thus the negatively-charged size only deflocculates incompletely.

Furthermore, aluminium sulphate reacts with calcium carbonate which is desirably used under neutral conditions as pigment and filler with the evolution of carbon dioxide, which results in foam formation and hole formation on the paper strip. Precipitated calcium sulphate leads to depositions on the machines used so that a disturbance-free manufacture of paper is not possible. Since, hitherto, no substitute has been found for aluminium sulphate, the usual resin sizes also cannot be used in the case of manufacturing paper under neutral conditions so that it is necessary to employ synthetic sizes which make the manufacture of the paper considerably more expensive.

One way out of this difficulty appeared to be the so-called "pseudo-neutral" procedure, with the use of only small amounts of aluminium sulphate. This is added very late to the thin slurry so that the above-described undesired reactions do not give rise to difficulties. In order to compensate the reduced precipitation action of the alum at the pH values of 6.5 to 7.4 hereby present, it is, however, necessary to add other cationic agents to the material suspension. Nevertheless, there is always the danger that the calcium hydrogen carbonate formed by the reaction of evolved carbonic acid with calcium carbonate again breaks down in the course of the paper manufacture to give calcium carbonate and carbon dioxide and calcium carbonate depositions arise which result in interruptions of the production.

A modified pseudo-neutral paper manufacturing method is described in published Japanese Patent Application No. 83-174 696. In this case, a dicyandiamide-formaldehyde condensation product is added to the aluminium sulphate as an additional agent. However, this process still suffers from the disadvantage of having to use an expensive diketene resin.

In published European Patent Specification No. 0,112,525, there is disclosed an agent for the neutral sizing of cellulose-containing materials which consists of water, an alcohol of unlimited solubility in water, alkali metal or aluminium hydroxide, as well as a saturated or unsaturated fatty acid containing 12 to 24 carbon atoms.

The object of a neutral procedure in the manufacture of paper is substantially to reduce the use of aluminium sulphate or to exclude its use entirely and to replace kaolin as filling material or pigment by calcium carbonate. The latter is more economical than kaolin and its degree of whiteness exceeds that of kaolin. Furthermore, due to the more favourable flow behaviour of calcium carbonate, higher degrees of filling in the paper can be achieved. In addition, the corrosion of the mechanical devices used is reduced and the quality of the paper, especially its aging stability, is considerably improved.

Therefore, it is an object of the present invention to provide a paper manufacturing process which operates at a neutral to weakly basic pH value and, under these conditions, avoids the disadvantages of the previously known processes.

Thus, according to the present invention, there is provided a process for sizing in the production of paper, cardboard, paperboard and other cellulose-containing materials with and without filling materials and/or pigments by natural or synthetic sizing agents under neutral to weakly basic pH conditions, wherein sizing is carried out with a combination of natural or synthetic sizing agents with a cationic dicyandiamide resin.

Surprisingly, we have found that cationic dicyandiamide resins are able, under neutral to weakly basic pH conditions, also to flocculate natural sizing agents and to fix on to the fibres. Therefore, with the help of such dicyandiamide resins, a complete sizing can be achieved even without the addition of aluminium sulphate.

Also in the case of synthetic sizes based on diketene, by means of cationic dicyandiamide resins there can, surprisingly, be achieved a complete or partial sizing, in which case no further adjuvants or fixing agents are necessary.

Cationic dicyandiamide resins have proved to be especially suitable which possess a high positive charge and, therefore, able to precipitate out anionic high molecular weight materials rapidly and practically quantitatively. These resins are preferably adjusted to be not too acidic in order that the pH value does not drop substantially below 7 after mixing with the material suspension.

The production of the cationic dicyandiamide resins used according to the present invention can take place, for example, by the reaction of 1 mole of dicyandiamide with 1.0 to 4.0 mole of formaldehyde in the presence of 0.1 to 2.0 mole of at least one inorganic or organic acid and/or at least one ammonium or amine salt thereof and optionally of up to 0.5 mole of a di- or polybasic amine. Condensation products so produced have pH values of from about 3 to about 5, are miscible with water in all proportions and can be readily used as approximately 50% aqueous solutions.

As acids, there can be used, for example, strong inorganic acids, such as hydrochloric acid, sulphuric acid or nitric acid. However, it is preferred to use more weakly acidic organic acids, for example, formic acid, acetic acid or oxalic acid.

As ammonium salts for the production of the resins, there can be used, for example, ammonium salts of strong inorganic acids, for example ammonium chloride or ammonium sulphate, or ammonium salts of organic acids, for example ammonium formate or acetate. As amine salts, there can be used salts of organic amines with inorganic or organic acids, for example ethylenediamine formate or triethylenetetramine hydrochloride. The mentioned salts can also be employed in admixture with inorganic or organic acids.

As amine components optionally also to be added, there can be used di- or polybasic aliphatic amines, ethylenediamine, propylenediamine, diethylenetriamine and triethylenetetramine being preferably used. There can also be used the derivatives thereof substituted on the nitrogen by hydroxyl groups, for example mono-or diethanolamine. If amines are added, the amount thereof is preferably at least 0.05 mole per mole of dicyandiamide.

Formaldehyde can be used in any desired form but preferably in the form of 30 to 40% by weight aqueous solutions thereof.

By neutral to weakly basic pH values, there are here to be understood those of from pH 6.5 to 8.5 and preferably of from 7.0 to 8.0.

The condensation products obtained by the above-described process are clear and colourless products which are miscible with water in all proportions.

However, within the scope of the present invention, there can also be used cationic dicyandiamide resins produced by other processes.

The amount of cationic dicyandiamide resin to be used is referred to the amount of "material" (cellulose) and is generally from 0.1 to 10% by weight and preferably from 0.2 to 5% by weight, preferably in the form of an approximately 50% aqueous solution.

In the case of the process according to the present invention, there can be used all commercially available sizes based on natural or synthetic starting materials. Suitable products include, for example, colophony, animal size, casein, starch, waxes, fatty acids and tall resins. Of the synthetic sizes, there are especially suitable products based on ketene dimers, polyvinyl alcohols or polyvinyl acetates. As ketene dimers, products can be used which have been produced from alkyl-substituted, dimeric diketenes with an oxetanone structure, starting from long-chained fatty acids, such products being commercially available under the trade name "Aquapel". In the same way, there can also be used modified resin sizes such as are obtained, for example, by reacting, for example, colophony with dienophilic acids, such products being commercially available under the trade name "Furtin" 3 N/S. Furthermore, extremely finely divided dispersions of specially modified, reinforced resins, for example "Furtin" BVR 510, can advantageously be used.

By combination of cationic dicyandiamide resin with the above-mentioned, chemically very different size components, the process according to the present invention permits, surprisingly, these to be flocculated and fixed on to the fibres. In this way, without the help of further adjuvants, a complete or partial sizing of the paper can be achieved with natural, synthetic or modified resin sizes.

All filling materials and pigments conventionally used in the manufacture of paper can also be used in the process according to the present invention, for example, kaolin, aluminium silicates, calcium silicates, oxyhydrates of aluminium, talcum, satin white, gypsum, barium sulphate, barium carbonate, magnesite, zinc oxide, titanium dioxide. However, calcium carbonate is preferably used. This can consist of natural calcium carbonate in finely divided form or can also be precipitated calcium carbonate. Calcium carbonate is preferred because its degree of whiteness is superior, for example, to that of kaolin and its favourable flow behaviour permits the achievement of especially high degrees of filling in the paper. In this way, the properties of the paper are also positively influenced: the opacity is increased, the degree of whiteness is improved, the resistance to ageing is increased and the mechanical properties are increased.

The following Examples are given for the purpose of illustrating the present invention and show, in particular, which differing kinds of size can be applied to cellulose fibres by cationic dicyandiamide resins under neutral or weakly basic conditions and which good results are thus achieved.

EXAMPLES

For the preparation of a cationic dicyandiamideformaldehyde resin, 84 parts by weight of dicyandiamide, together with 220 parts by weight of 30% formaldehyde solution (aqueous) and 43 parts by weight of ammonium chloride, are placed in a stirrer vessel equipped with a reflux condenser. 7.7 parts by weight of 78% ethylenediamine are then added thereto at ambient temperature, while stirring. The reaction commences immediately and the temperature of the reaction mixture increases to 90° to 95° C. After about 10 minutes, the reaction is finished. Water is then added thereto in order to adjust a concentration of 50% by weight of solids in the resin solution.

Instead of ethylenediamine, there can also be used, for example, the corresponding amount of diethylenetriamine, triethylenetetramine or diethanolamine.

Instead of ammonium chloride, there can be used an inorganic or organic acid, for example hydrochloric acid or formic acid.

Example 1

Sheets are formed on a Rapid-Köthen sheet former with the use of bleached wood cellulose with a degree of grinding of 24° SR, resin size (free resin size Furtin 3N) and 50% aqueous cationic dicyandiamide resin (produced from dicyandiamide, formaldehyde, ammonium chloride and ethylenediamine) and thermally treated on cylinders for 3 minutes at 120° C. After climatisation, the sizing is determined by the water take-up using the Cobb test (60 seconds) according to German Industrial Standard DIN 53132. The use of the cationic dicyandiamide resin was compared with the use of alum as sizing agent, the pH value thereby adjusting itself.

The results set out in the following Table 1 provide a comparison of the effectiveness of the paper production process according to the present invention using a cationic dicyandiamide resin with a process using alum:

TABLE 1

| resin size addition in wt. %, referred to cellulose | Cobb test 60 sec. in g/m$^2$ | | pH value of the suspension |
|---|---|---|---|
| | sieve side | upper side | |
| cationic di- | | | |

TABLE 1-continued

| resin size addition in wt. %, referred to cellulose | | Cobb test 60 sec. in g/m² sieve side | Cobb test 60 sec. in g/m² upper side | pH value of the suspension |
|---|---|---|---|---|
| | cyandiamide resin in wt. % referred to cellulose | | | |
| 1.5 | 1 | 35 | 42 | 7.4 |
| 1.5 | 4 | 16 | 22 | 7.3 |
| 3.0 | 2 | 18 | 17 | 7.4 |
| 3.0 | 4 | 14 | 18 | 7.3 |
| | alum in wt. % referred to cellulose | | | |
| 1.5 | 1 | 73 | 73 | 7.0 |
| 1.5 | 4 | 77 | 72 | 6.1 |
| 3.0 | 2 | 84 | 81 | 6.6 |
| 3.0 | 4 | 69 | 65 | 6.1 |

Result: At pH values above 7, in the case of the use of cationic dicyandiamide resin, there can be achieved a full sizing which cannot be achieved in this pH range in the case of using alum.

Example 2

Sheet Formation with the Use of Calcium Carbonate as Filling Material

The experimental conditions are the same as those used in Example 1 but weakly anionic calcium carbonate is added as filling material. The weight ratio of cellulose to filling material is 1:2. The filling material is prepared for 5 minutes in an Ultra-Turrax dispersing apparatus, subsequently mixed with the cellulose for 3 minutes and thereafter the size and the cationic dicyandiamide resin added thereto. The results obtained are set out in the following Table 2:

TABLE 2

| resin size in wt. % referred to cellulose | cationic dicyandiamide resin in wt. % referred to the amount of cellulose and filling material | Cobb test 60 sec. in g/m² sieve side | Cobb test 60 sec. in g/m² upper side | pH value of the suspension |
|---|---|---|---|---|
| 5 | 0.2 | 47 | 46 | 7.5 |
| 5 | 0.5 | 30 | 33 | 7.5 |
| 5 | 1.0 | 23 | 23 | 7.5 |
| 7 | 1.0 | 19 | 20 | 7.5 |
| 7 | 2.0 | 20 | 18 | 7.5 |

Result: The use of cationic dicyandiamide resin permits a full sizing to be achieved in the pH region of 7.5 in the case of the use of resin size and calcium carbonate as filling material without the addition of alum.

Example 3

Sheet Formation with the Use of Diketene Size and Calcium Carbonate as Filling Material There is used the same cationic dicyandiamide resin and the same calcium carbonate quality as in Example 2. For sizing, there is used a synthetic product based on diketene (Aquapel 2). The quality of the sizing is ascertained by means of the Cobb test. The results obtained are set out in the following Table 3:

TABLE 3

| diketene size Aquapel 2 in wt. % referred to cellulose | cationic dicyandiamide resin in wt. % referred to the amount of cellulose and filling material | Cobb test 60 sec. in g/m² sieve side | Cobb test 60 sec. in g/m² upper side | pH value of the suspension |
|---|---|---|---|---|
| 2 | 0 | 80 | 80 | 7.5 |
| 2 | 0.5 | 32 | 32 | 7.5 |
| 3 | 0 | 30 | 35 | 7.5 |
| 3 | 0.2 | 17 | 17 | 7.5 |
| 3 | 0.4 | 19 | 18 | 7.5 |

Result: Even by the addition of small amounts of cationic dicyandiamide resin, the sizing is considerably improved; the pH value of the material suspension is not changed by the addition of this resin.

Example 4

Sheet Formation with the Use of a Completely Saponified Resin Size Without Filling Material As dicyandiamide resin, in this Example there is used a condensation product of dicyandiamide, formaldehyde and formic acid containing 50% by weight of solids, the mole ratio of the components being 1:1.5:0.5. The size used is a completely saponified resin size (Furtin 3 N/S). From the sheets produced, there are determined the Cobb values in the manner described in Example 1. The results obtained are set out in the following Table 4:

TABLE 4

| resin size in wt. % referred to cellulose | cationic dicyandiamide resin in wt. % referred to the amount of cellulose | Cobb test 60 sec. in g/m² sieve side | Cobb test 60 sec. in g/m² upper side | pH value of the suspension |
|---|---|---|---|---|
| 1.5 | 1 | 35.9 | 27.1 | 7.5 |
| 1.5 | 2 | 48.2 | 31.4 | 7.4 |
| 1.5 | 3 | 30.4 | 27.6 | 7.2 |
| 1.5 | 4 | 27.6 | 22.9 | 7.2 |
| 3.0 | 5 | 25.6 | 19.7 | 7.1 |

Result: In the case of the use of a completely saponified resin size and the use of a cationic dicyandiamide resin, a good sizing effect can be achieved at pH values above 7.

Example 5

Sheet Formation with the Use of a Completely Saponified Resin Size and Filling Material There is used the same dicyandiamide resin and the same resin size as in Example 4. Weakly anionic calcium carbonate is used as filling material. The sheets are produced in a manner analogous to that described in Example 1. The results obtained are set out in the following Table 5:

TABLE 5

| resin size in wt. % referred to cellulose | cationic dicyandiamide resin in wt. %, referred to the amount of filling material | Cobb test 60 sec. in g/m² sieve side | Cobb test 60 sec. in g/m² upper side | pH value of the suspension |
|---|---|---|---|---|
| 6 | 1 | 79.7 | 79.0 | 7.4 |
| 6 | 2 | 77.9 | 75.1 | 7.4 |
| 6 | 3 | 67.3 | 64.1 | 7.3 |
| 6 | 4 | 53.2 | 52.9 | 7.3 |
| 6 | 6 | 25.5 | 24.3 | 7.4 |

Result: Also in the case of the use of anionic calcium carbonate as filling material and in the case of the use of fully saponified resin size, at pH values above 7 a sufficient sizing effect can be achieved.

Example 6

Sheet Formation Without Filling Material

Sheets are formed with the use of the same cationic dicyandiamide resin as mentioned in Example 4, as well as of a finely dispersed, specially modified resin size (Furtin BVR 510), in the manner described in Example 1. The properties of the sheets produced are set out in the following Table 6:

TABLE 6

| resin size in wt. % referred to cellulose | cationic dicyandiamide resin in wt. % referred to the amount of cellulose | Cobb test 60 sec. in g/m² sieve side | Cobb test 60 sec. in g/m² upper side | pH value of the suspension |
|---|---|---|---|---|
| 3 | 0.2 | 34.5 | 31.6 | 7.4 |
| 3 | 0.5 | 32.1 | 26.6 | 7.2 |
| 3 | 1.0 | 29.3 | 24.2 | 7.1 |
| 3 | 2.0 | 29.6 | 23.4 | 7.0 |

Result: The combination of cationic dicyandiamide resin with a specially modified resin size also provides outstanding Cobb values at pH values of >7.

Example 7

Sheet Formation with the Use of a Modified Resin Size Filling Material

With the use of the cationic dicyandiamide resin mentioned in Example 6, of the same specially modified resin size and weakly anionic calcium carbonate as filling material, sheets are produced in the manner described in Example 1, the Cobb values of which are set out in the following Table 7:

TABLE 2

| resin size in wt. % referred to cellulose | cationic dicyandiamide resin in wt. % referred to the amount of cellulose and filling material | Cobb test 60 sec. in g/m² sieve side | Cobb test 60 sec. in g/m² upper side | pH value of the suspension |
|---|---|---|---|---|
| 6 | 1 | 21.3 | 20.2 | 7.2 |
| 6 | 2 | 32.5 | 25.4 | 7.2 |
| 6 | 4 | 21.8 | 20.9 | 7.1 |

Result: By combination of a cationic dicyandiamide resin with a specially modified resin size and filling material, a complete sizing is achieved even in the case of pH values above 7.

We claim:

1. In a process for sizing in the production of paper, cardboard, paperboard and other cellulose-containing materials by natural sizing agents, the improvement comprising:

sizing the cellulose-containing materials, under neutral to weakly basic pH conditions and without the use of aluminium salts, by the steps of first adding a natural sizing agent to a suspension of said materials and then adding an aqueous solution, containing up to 50% by weight of solids, of a condensation product consisting essentially of dicyandiamide with formaldehyde in molar ratio of from 1:1.0 to 1:4.0, said product having been prepared in the presence of at least one inorganic or organic acid and/or at least one ammonium or amine salt of an inorganic or organic acid.

2. The process of claim 1 wherein the condensation product is prepared in the further presence of a di- or poly-basic amine, the mole ratios in said condensation product being in the following ranges:

dicyandiamide—1
formaldehyde—1.0 to 4.0
acid and/or ammonium or amine salt—0.1 to 2.0
di- or poly-basic amine—0.05 to 0.5.

3. The process of claim 2 wherein the amine used is ethylenediamine, diethylenetriamine or diethanolamine.

4. The process of claim 1, wherein there is used 0.1 to 10% by weight of the cationic dicyandiamide resin, referred to the amount of cellulose.

5. The process of claim 4, wherein there is used 0.2 to 6% by weight of the cationic dicyandiamide resin, referred to the amount of cellulose.

6. The process of claim 1 wherein the cationic dicyandiamide resin is a condensation product of dicyandiamide with formaldehyde, said product having been prepared in the presence of a mixture of ammonium and amine salts, as well as of free acids.

7. The process of claim 1 wherein the sizing agent is colophony, animal size, casein, starch, wax, fatty acids or tall resins.

8. The process of claim 1 wherein finely ground or precipitated calcium carbonate is used as filling material and/or pigment.

9. The process of claim 1 wherein the pH is neutral to about 7.5.

10. The process of claim 9 wherein the dicyandiamide resin is a condensation product of dicyandiamide and formaldehyde prepared in the presence of ammonium chloride, hydrochloric acid or formic acid, and of ethylenediamine, diethylenetriamine, triethylenetetramine or diethanolamine.

* * * * *